United States Patent [19]

Unrug

[11] 4,410,296

[45] Oct. 18, 1983

[54] ROCK BOLT OVERLOAD WARNING DEVICE

[76] Inventor: Kot F. Unrug, 2917 Waco Rd., Lexington, Ky. 40503

[21] Appl. No.: 316,973

[22] Filed: Oct. 30, 1981

[51] Int. Cl.[3] ..... E21D 21/02

[52] U.S. Cl. ..... 405/259; 411/8

[58] Field of Search ..... 405/259, 260, 261; 411/10, 8, 9, 1, 3

[56] References Cited

U.S. PATENT DOCUMENTS

| | | | |
|---|---|---|---|
| 2,943,528 | 7/1960 | Curry | 411/9 X |
| 3,072,093 | 1/1963 | Lanius | 411/8 |
| 3,187,621 | 6/1965 | Turner | 411/10 |
| 3,788,186 | 1/1974 | Crites | 411/8 |
| 4,092,081 | 2/1978 | Curtis | 411/10 |
| 4,112,693 | 9/1978 | Collin | 405/259 X |
| 4,156,236 | 5/1979 | Conkle | 405/259 X |
| 4,334,803 | 6/1982 | Westlake | 405/259 |

*Primary Examiner*—Nile C. Byers, Jr.

*Attorney, Agent, or Firm*—Birch, Stewart, Kolasch and Birch

[57] ABSTRACT

A washer is described which is used in the construction of the support for the roof of a mine. The washer is fabricated such that finger like projections rupture in stages as the tension on bolts and pressure in the strata of the roof of the mine increases beyond structurely safe limits. The rupturing of the washer emits audible warning signals and also provides a visual indication of an unsafe condition.

18 Claims, 4 Drawing Figures

SOLID LINE - ROCK BOLT WITHOUT WARNING WASHER

DOTTED LINE - ROCK BOLT WITH WARNING WASHER

21 - PRESTRESS
22 - WORKING RANGE
23 - END OF ELASTIC RANGE
24 - END OF YIELDING RANGE
25 - FAILURE

DIAGRAM OF ROCK BOLT WORK

ROCK BOLT OVERLOAD WARNING DEVICE

BACKGROUND OF THE INVENTION

This invention relates to an overload warning device for use in mine roof construction and more specifically to a warning system capable of providing an audible warning signal indicating structural deficiency in the roof of a mine.

In underground mining there is constant danger both to the mine workers and the expensive mining machinery of a shift in the strata above the mine passage or tunnel eventually leading to a cave in if precautionary measures are not taken.

Minor shifts of the strata in the mine roof indicative of pending disaster are not always noticeable to the naked eye of even an experienced mining engineer. The use of bolts, instead of supporting timbers, to hold the mine roofs in place are well known in the art. The bolts are inserted into holes that have been drilled into the roof and the upper ends of the bolts are expanded in some manner to anchor them in place. The bolts are further provided with a mounting plate which abuts against the mine roof. The bolts are tightened to bolt the various strata of the roof together and to cause expansion of the anchor means against the interior of the drilled hole. Tension is imparted to the bolt by drawing up the bolt head in a tight abutment with the lower surface mounting plate. Nevertheless, in time the strata may start to separate and develop a load on the bolt. If the load becomes great enough, the bolts will stretch and fail without warning, thereby allowing the roof to collapse.

It is highly desirable to have an early warning system established for detecting the dangerous conditions which can develop in the roof of a mine. Various mine roof warning devices have previously been suggested which respond to the shifts in the strata of the roof of a mine such that some form of signal means is activated to alert pending disaster. For example, elaborate sensing devices which provide visual signs of increased pressures being applied to the ceiling bolts such as in the form of flag warning systems, the installation of a series of weakened bolts, the ruptured bolts being visually detected on the floor of the mine, and various battery operated or electrically actuated signal devices, which are either inefficient, impractical or expensive, have been disclosed.

While, as stated above, the practice of bolting roof plates to the rock structure of the roof of the tunnel is widely used to inhibit the shifting of the rock, occasionally the rock formation will shift regardless of the presence of the bolts, causing a very dangerous situation. In this regard, such a shift in the rock formation may result in the collapse of the mine tunnel roof entirely. It is therefore, imperative to have a positive and reliable means for ascertaining any shift in the rock formation above the tunnel roof.

When the rock formation above the tunnel roof shifts, a resulting stress is placed upon the bolts which are located within the rock, the tensile stress imparted thereto being transferred to a bolt head generally secured to the end of the bolts which is visible from within the tunnel in close proximity to a metal roof plate. A measurement of the increase of the stress imparted to the mine roof supporting bolt translated into the form of a broken weaker bolt, a flag or an electrically generated signal as a means for indicating dangerous shifts in the rock formation can be recorded. Such means for indicating the shifting of rock formations will only be as reliable as the means for indicating the added stresses imparted to the bolt.

When the detection device relies solely upon visual means, the weakening of the roof of the mine and the impending rupture of the bolt may be overlooked due to the environment in which the workers are employed, intensity of the concentration of the worker or just carelessness. In order to overcome these disadvantages, a truly efficient and practical indicating means would provide an audible signal which clearly identifies danger stresses imparted to the bolts without requiring critical measurements as to stresses being imparted from within the strata or conscious observation on the part of the working personnel.

SUMMARY OF THE INVENTION

It is, therefore, an object of the present invention to provide a mine warning device and more particularly a mine roof warning system which will overcome the above noted disadvantages.

It is another object of the present invention to provide a mine warning system which is not dependent only upon visual observation.

A further object of the present invention is to provide a mine roof warning device which when attached to the mine roof will initiate a warning signal when the load exceeds 70% of the bolt strength limit.

Still another object of the present invention is to provide a bolt stress indicator which signals excessive stress imparted to a bolt by way of an audible signal.

Yet, another object of the present invention is to provide a stress indicator, simple in construction which affords an inexpensive means for indicating when excessive stresses are imparted to a mine roof bolt.

Still a further object of the present invention is to provide a mine roof warning signal which is multidirectional and will give adequate warning of strata shift to miners working in any direction from the installed device.

It is yet another object of the present invention to provide a mine roof warning device which is simple in construction, has a minimum number of parts, inexpensive to manufacture and is at all times efficient, reliable and safe in operation.

The foregoing objects and others are accomplished in accordance with the present invention, generally speaking, by providing a warning device in the form of a suitably constructed washer used with a rock bolt adapted to the support for the roof of a mine shaft. The washer, due to the nature of its material and construction, systematically fragments in response to excessive pressure resulting from change in the strata of the roof of a mine. The material used for the washer has a high modulus of elasticity and is able to store substantial amounts of elastic energy when loaded. Any suitable material may be used which satisfies these requirements such as aluminum alloy materials No. 7075-T6 as identified in the Central Wire and Steel Co. Materials Handbook Tables. When ruptured, released energy produces a sound wave with high frequency. The washer of the present invention comprises a cylindrical body with angular projections therefrom spacially arranged in a stepwise manner on at least one surface of the body structure. Preferably, the projections are paired elements located at equidistant intervals on the periphery of the washer, lateral to the center opening thereof. There are always three singular or paired breakable projecting elements with the same height spaced 120° apart around the periphery of the washer and therefore every second projection or pair of projections on the perimeter has or have the same dimension. Thus, there is always maintained a plane of contact defined by at least three points of contact. The projections are generally machined to a height between 6 mm to 8 mm at an acute angle of about 60 degrees. The breaking off of the angular projection or raised portion of the washer generates a high-frequency, audible warning signal of adequate volume so as to be heard even in the vicinity of the face of the mine where the overall noise level is quite high. As described above, the washer is fabricated such that the projections emit warning sounds at the several intervals as the projections are reached and rupture due to the build up of pressure in the roof of the mine. The utilization of the warning washer in no way affects the normal construction procedure related to the installation of the rock bolts with the roof plate for supporting the roof of the mine openings. The warning washer is generally installed between the roof plate and a small steel washer next to the bolt head. Further, as a backup, the rupturing of the washer results in the breaking off of the respective projections thus providing a visual warning signal in addition and subsequent to the audible warning signal.

It has been determined in the course of the present invention that as the strata of the mine roof shifts and changes, the pressure in the mine roof increases, thus the roofing bolts utilized in the fabrication of the support structure for the roof of the mine undergo breaking or rupturing stresses. A washer is provided which, due to its unique configuration, selectively ruptures as the pressure in the mine roof builds thereby producing sharp warning sounds when the defined projections rupture thus providing numerous warning signals, which increases the probability that the latter will be heard. This increases the security for the workers in the mine.

GENERAL DESCRIPTION OF THE DRAWINGS

The present invention will become more fully understood from the detailed description given hereinbelow and the accompanying drawings which are given by way of illustration only and are not intended to be limitative of the present invention. In the various illustrations where the elements are the same, similar numbers are retained.

Figure 1:
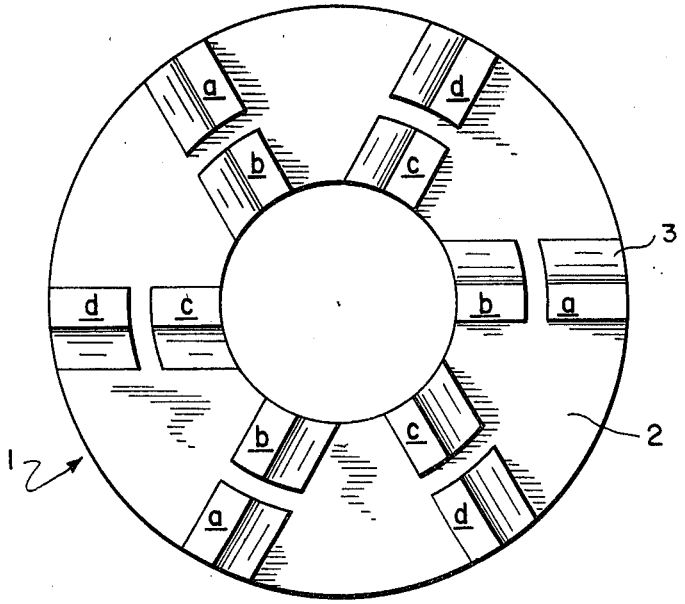
FIG. 1 represents a top view of the warning washer of the present invention.
Figure 2:
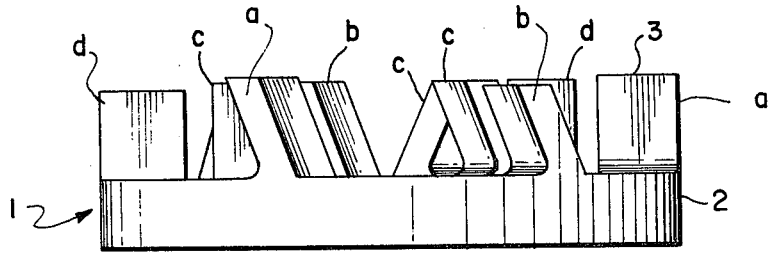
FIG. 2 represents a side view of the warning washer of the present invention.

Referring now to FIG. 1, there is seen the warning washer of the present invention generally designated 1 comprising a base 2 with projecting elements 3. The projecting elements which correspond to each other in height with designation a, b, c, and d are located 120° apart and provide multiple audible sounds as the bolt is stressed and the washer ruptures at the various projections. The breaking elements of the washer are designed to maintain tension on the bolt rod. The drop in tension due to breaking is in the range of 1000 lbs. The first break occurs when the tension reaches about 70% of the building load further discussed below with respect to FIG. 4. FIG. 2 is a side view of the washer displayed in FIG. 1. The washer 1 comprises base 2 having the various stepped elements. The projections are grouped together in pairs in radial direction, however elements with the same height are spaced 120° apart about the periphery of the base 2. The position of the elements are shown corresponding to the first, second, third and fourth step and are named a, b, c, and d respectively.

Figure 3:
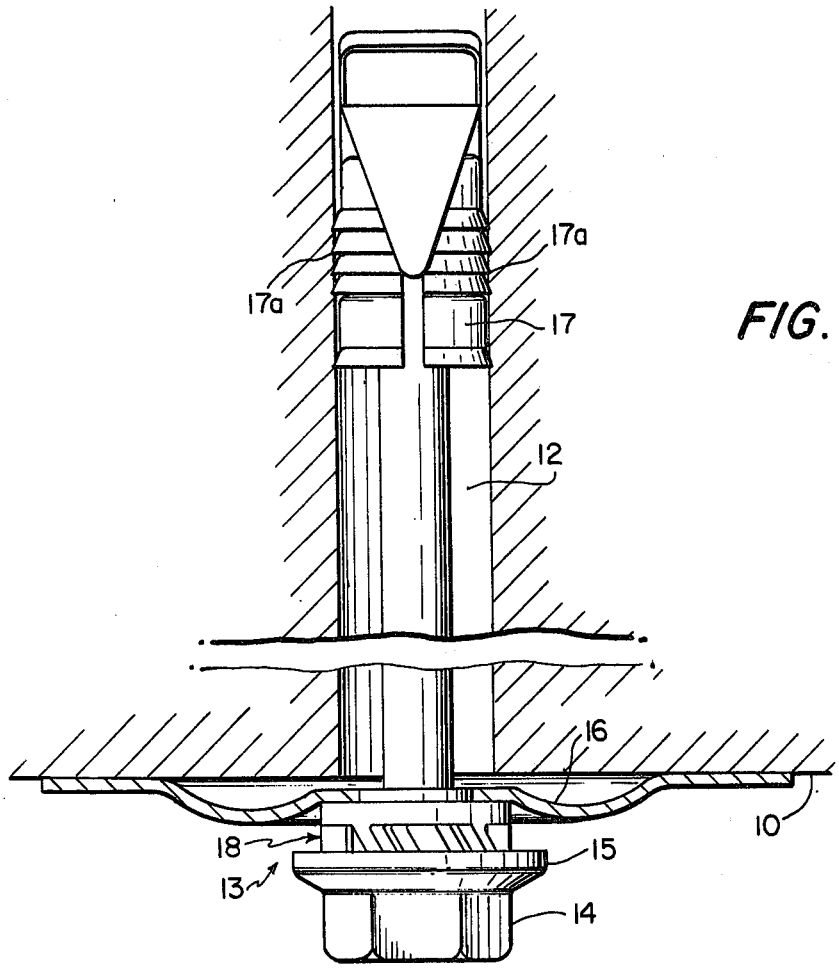
FIG. 3 is a side view of a mine bolt in place in the roof of a mine.

In FIG. 3 there is seen a mine roof 10 bolted together at suitable intervals by a standard rock bolt 13 which extends up into a hole 12 drilled in the roof of the mine. Generally, the upper end of the bolt is threaded into a wedged shape expansion shell nut 17, and the lower end of the bolt has a head 14 and a washer 15 that supports a heavy metal plate 16 which engages the roof. The expansion shell nut 17 is generally provided with teeth 17*a* that engage the sides of the hole upon tightening of the bolt such that the bolt will push the plate 16 up tightening against the roof 10. The illustration herein presented represents just one of a number of techniques that may be used to secure the roof of a mine. Interposed between the roof plate 16 and the steel washer 15, is the washer 18 of the present invention. As the pressure in the roof of the mine increases to a point as to apply added tension on the bolts, the warning washer will partially break at the various step levels producing sharp warning sounds, thus providing the worker with an early warning signal.

Figure 4:
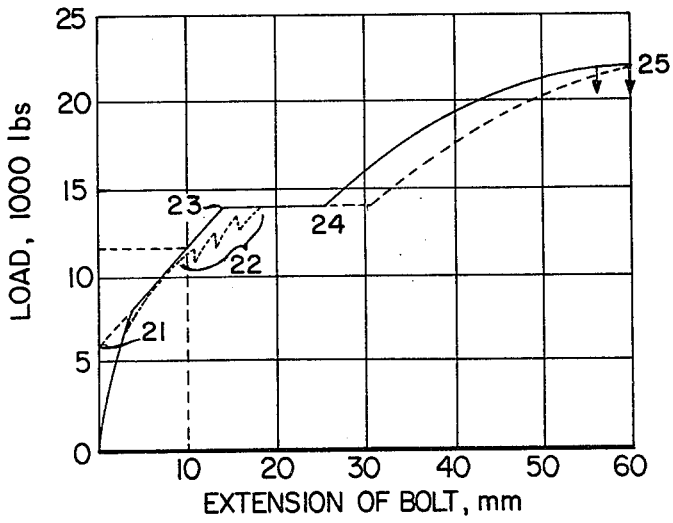
FIG. 4 represents a diagram of the influence of the warning washer on the load characteristics of the bolt.

FIG. 4 is a diagram of rock bolt work, i.e. the influence of the warning washer on the load characteristics of the bolt. The dotted line shows the extension of the bolt versus the bolt load with the washer as compared with the solid line corresponding to the bolt without the warning washer. The solid line represents the extension of the rock bolt without the warning washer and the dotted line represents the extension of the rock bolt with the warning washer. The prestress stage is represented at point 21, the working range 22, the end of the elastic range of the bolt 23, the end of the yielding range 24 and the failure of the bolt at 25. As is apparent from the diagram the only difference depends on the larger extension of the bolt line to the rupture of the warning steps of the washer. The first rupture appears in the range of approximately 70% of the ultimate bolt load. When the first step or finger like projection breaks emitting the first audible warning signal, the tension drops about 1000 lbs., and when the deformation of the roof increases, the next step or projection is further subjected to the increased load. Repeating ruptures of the stepped projections similar in nature correspond to the jumps on the diagram. When all the stepped projections are broken, the bolt arrangement is reduced to a configuration absent the warning washer. The warning washer of the present invention also serves as a dynamometric device which measures the forces being applied to the bolt. Inasmuch as the rupturing of the finger like projections corresponds to certain specific loads, detection of the broken elements upon visual inspection can be translated into approximations as to the forces being applied.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A mine roof warning device comprising a washer having a base member with at least three corresponding rupturable angular finger like protrusions projecting from at least one surface thereof spaced at equal distances around the periphery of said base, with each of said corresponding respective protrusions having the same height.

2. The device of claim 1 wherein said angular protrusions comprise a plurality of singular rupturable projecting elements of varying heights spaced at equidistant intervals about the circumference of said washer base such that as said corresponding projections rupture there is always maintained a plane of contact defined by points of contact of at least three of said remaining projecting elements of the same height translated to the mine roof.

3. The device of claim 2 wherein those projecting elements not of the same height are spatially arranged in a stepwise manner around the periphery of the base of said washer.

4. The device of claim 2 wherein each of said corresponding projections or projecting elements having the same height are spaced 120° apart.

5. The device of claim 3 wherein said projections or projecting elements extend from the surface of said washer at an angle of about 60° to a stepped height of from about 6 mm to 8 mm.

6. A mine roof warning device comprising a washer having a base member with at least three stepped paired rupturable angular finger like projections extending from a surface of said base of said washer, said stepped paired projections being spaced at 120° around the periphery of said base, said projections extending from the surface of the base of said washer at an angle of about 60° to a stepped height of from about 6 mm to 8 mm, wherein said at least three paired projections comprise corresponding projecting elements having the same height.

7. A mine roof support fixture comprising in combination a roof plate, a bolt having a head and threaded portion, and a washer interpositioned between said plate and the head of said bolt, said washer comprising a base member with at least three corresponding rupturable angular finger like protrusions projecting from at least one surface thereof spaced at equal distances around the periphery of said base with each of said corresponding respective protrusions having the same dimension height.

8. The mine roof support fixture of claim 7 wherein said angular protrusions comprise a plurality of singular rupturable projecting elements of varying heights spaced at equidistant intervals about the circumference of said washer base, such that as said corresponding projections rupture a plane of contact defined by points of contact of at least three of said remaining projecting elements of the same height is always maintained with the surface of the head of said bolt.

9. The mine roof support fixture of claim 8 wherein those projecting elements not of the same height are spatially arranged in a stepwise manner around the periphery of the base of said washer.

10. The mine roof support fixture of claim 8 wherein each of the corresponding projections or projecting elements having the same height are spaced 120° apart.

11. The mine roof support fixture of claim 9 wherein said projections or projecting elements extend from the surface of said washer at an angle of about 60° to a stepped height of from about 6 mm to 8 mm.

12. The mine roof support fixture of claim 7 further including a flat washer interposed between said warning washer and said head of said bolt.

13. The device of claim 4, wherein said projections or projecting elements extend from the surface of said washer at an angle of about 60 degrees to a stepped height of from about 6 mm to 8 mm.

14. The mine roof support fixture of claim 10, wherein said projections or projecting elements extend from the surface of said washer at an angle of about 60 degrees to a height from about 6 mm to 8 mm.

15. The device of claim 2 wherein said plurality of singular projecting elements comprises at least three corresponding stepped paired projecting elements extending from said surface of said base member, said paired projecting elements being spaced at 120° around the periphery of said base member, said projecting elements extending from said surface at an angle of about 60° to a stepped height of from about 6 mm to 8 mm, wherein said at least three stepped paired projecting elements comprise corresponding elements having the same height.

16. The mine roof support fixture of claim 8 wherein said plurality of singular projecting elements comprises at least three corresponding stepped paired projecting elements extending from said surface of said base member, said paired projecting elements being spaced at 120° around the periphery of said base member, said projecting elements extending from said surface at an angle of about 60° to a stepped height of from about 6 mm to 8 mm, wherein said at least three stepped paired projecting elements comprise corresponding elements having the same height.

17. A mine roof warning device comprising a washer having a base member with six stepped paired rupturable angular finger like projecting elements extending from a surface of said washer, said stepped paired projecting elements being spaced at equal distances around the periphery of said base member with the alternate of said stepped paired projecting elements comprising corresponding elements of the same height spaced at 120° around the periphery of said base member, said projecting elements extending from the surface of the base of said washer at an angle of about 60° to a stepped height of from about 6 mm to 8 mm, such that, as said corresponding projecting elements of the same height rupture, there is always maintained a plane of contact defined by points of contact of at least three of said remaining projecting elements of the same height translated to the mine roof.

18. The mine roof warning device of claim 1, wherein said washer comprises a material having a high modulus of elasticity.

* * * * *